US005323700A

United States Patent [19]

Katsuyama et al.

[11] Patent Number: 5,323,700

[45] Date of Patent: Jun. 28, 1994

[54] BLADE TYPE SQUEEGEE DEVICE FOR A STENCIL PRINTING DEVICE

[75] Inventors: Junnosuke Katsuyama; Takanori Hasegawa, both of Tokyo, Japan

[73] Assignee: Riso Kagaku Corporation, Tokyo, Japan

[21] Appl. No.: 11,796

[22] Filed: Feb. 1, 1993

[30] Foreign Application Priority Data

Feb. 7, 1992 [JP] Japan ..... 4-22323

[51] Int. Cl.[5] ..... B41F 15/38

[52] U.S. Cl. ..... 101/119; 101/120

[58] Field of Search ..... 101/119, 120, 121, 127.1

[56] References Cited

U.S. PATENT DOCUMENTS 4,138,943 2/1979 Mitter ..... 101/120
5,095,816 3/1992 Hasegawa et al. .
5,152,218 10/1992 Ishikawa ..... 101/120

*Primary Examiner*—Edgar S. Burr
*Assistant Examiner*—John S. Hilten
*Attorney, Agent, or Firm*—Dickstein, Shapiro & Morin

[57] ABSTRACT

Ink leakage from the trailing edge of the stencil master plate is avoided and a stable ink supply is ensured when using a D-type printing drum including a concentric cylindrical part extending over a major part of an entire circumference of the printing drum and defining an ink permeable region, a non-concentric cylindrical or planar part extending over a minor part of an entire circumference of the printing drum and having a central axial line different from that of the concentric cylindrical part, and an outer circumferential surface on which a stencil master plate is to be mounted without losing the benefit of reducing the displacement of the press roller. A squeegee blade is in contact with the inner circumferential surface of the D-type printing drum, and, in order to maintain the contact between the squeegee blade and the inner circumferential surface of the D-type printing drum over its entire circumference and keep the contact pressure between the squeegee blade and the inner circumferential surface of the D-type printing drum at a prescribed level, a cam is provided for controlling the contact pressure between the squeegee blade and the inner circumferential surface of the D-type printing drum in synchronism with the rotation of the D-type printing drum.

3 Claims, 2 Drawing Sheets

BLADE TYPE SQUEEGEE DEVICE FOR A STENCIL PRINTING DEVICE

TECHNICAL FIELD

The present invention relates to an ink supply device for a stencil printing device, and in particular to an ink supply device for a stencil printing device using a squeegee blade.

BACKGROUND OF THE INVENTION

The rotary stencil printing device, well known as a stencil printing device, comprises a cylindrical, ink permeable printing drum which rotates around an axial line thereof with a stencil master plate wrapped around the outer circumferential surface thereof, printing ink being supplied from the inner circumferential surface of the printing drum, and a desired printing can be accomplished by pushing printing paper against the stencil master plate mounted on the outer circumferential surface of the rotating printing drum by using a press roller.

As an ink supply device for such a rotary stencil printing device, the applicant of the present invention previously proposed in Japanese patent application No. 2-37178 (Laid-Open Publication No. 3-240584) a squeegee blade type ink supply device which, by making use of a squeegee blade made of rubber-like elastic material engaging the inner circumferential surface of the printing drum at a certain squeegee angle, pushes and supplies printing ink from the inner circumferential surface of the printing drum by means of the squeegee blade which is stationary relative to the printing drum.

In such a stencil printing device, the printing drum normally consists of a cylinder having a circular cross section. In this case, since the inner circumferential surface of the printing drum is continuous over its entire circumference, the position of the squeegee blade relative to the inner circumferential surface of the printing drum is not substantially affected by the rotation of the printing drum, and the squeegee blade can be therefore fixedly secured.

However, in a stencil printing device using a cylindrical printing drum having a circular cross section, clamping means for the stencil master plate mounted on the outer circumference of the printing drum inevitably creates a large projection on the outer circumference, and the resulting large displacement of the press roller engaging therewith tends to cause an undesirably large impact accompanied by noises.

As another type of printing drum for a stencil printing device beside from the cylindrical printing drum having a circular cross section, there is known a printing drum having a non-circular cross section, or a D-type printing drum including an ink-permeable cylindrical part accounting for a major part of the entire circumference, and a non-concentric cylindrical part or a planar part accounting for a minor part of the entire circumference.

In a stencil printing device using a D-type printing drum, with the clamping means for the stencil master plate mounted on the non-concentric cylindrical part or the planar part of the printing drum, the projection on the outer circumference of the printing drum is generally decreased as compared to the case of a comparable cylindrical printing drum having a circular cross section, and the displacement of the press roller is accordingly reduced.

However, if the squeegee blade is fixedly secured, the squeegee blade is relatively more forcibly engaged by the non-concentric cylindrical part or the planar part of the printing drum, and this may adversely affect the supply of ink and the rotation of the printing drum.

To eliminate this problem and to prevent the excessive leakage of printing ink through the printing drum near the trailing edge of the stencil master plate, in Japanese patent application No. 02-37178 is proposed an ink supply device comprising a moveable structure for the squeegee blade in which the squeegee blade is forced away from the region corresponding to the non-concentric cylindrical part or the planar part of the printing drum. Patent applications corresponding to this Japanese patent application were filed in the United States, the United Kingdom, and Germany as U.S. patent application Ser. No. 07/654,105 (which has matured into U.S. Pat. No. 5,095,816), British Patent Application No. 9,103,387.8 (Publication No. 2,240,905), and P 41 05 292.7, respectively, and the contents of these patent application and the patent are incorporated herein by reference.

The excessive ink leakage at the trailing edge of the stencil master plate can be avoided if the squeegee blade is moved away from the inner circumferential surface of the printing drum in the region corresponding to the non-concentric cylindrical part or the planar part of the printing drum, but the ink reservoir which is developed in a triangular region defined by the squeegee blade and the inner circumferential surface of the printing drum behind the point of contact between the squeegee blade and the inner circumferential surface of the printing drum as seen in the rotational direction of the printing drum may be disrupted or disturbed to such a extent that the supply of ink which depends on the stable maintenance of the ink reservoir may be adversely affected.

BRIEF SUMMARY OF THE INVENTION

The present invention was made in view of such problems of the conventional stencil printing device, and its primary object is to provide a blade type squeegee device for a stencil printing device which can ensure the prevention of the excessive leakage at the trailing edge of the stencil master plate and the stable supply of printing ink even when the reduction in the displacement of the press roller is achieved with the use of a D-type printing drum, and allows high printing quality to be achieved with a low noise level.

According to the present invention, such an object can be accomplished by providing a blade type squeegee device for a stencil printing device, comprising: a printing drum including a concentric cylindrical part extending over a major part of an entire circumference of the printing drum and defining an ink permeable region, a non-concentric cylindrical or planar part extending over a minor part of an entire circumference of the printing drum and having a central axial line different from that of the concentric cylindrical part, and an outer circumferential surface on which a stencil master plate is to be mounted; a squeegee blade engaging an inner circumferential surface of the printing drum; and pressure control means for maintaining contact between the squeegee blade and the inner circumferential surface of the printing drum over an entire circumference thereof, and controlling a contact pressure between the squeegee blade and the inner circumferential surface of the printing drum to a prescribed level with respect to the concentric cylindrical part and the non-concentric cylindrical or planar part in synchronism with the rotation of the printing drum. The squeegee device may further comprising means for preventing reduction in a squeegee angle of the squeegee blade engaging the non-concentric cylindrical or planar part of the printing drum.

To accomplish such an object, the blade type squeegee device for a stencil printing device of the present invention may comprise a printing drum including a concentric cylindrical part extending over a major part of an entire circumference of the printing drum and defining an ink permeable region, a non-concentric cylindrical or planar part extending over a minor part of an entire circumference of the printing drum and having a central axial line different from that of the concentric cylindrical part, and an outer circumferential surface on which a stencil master plate is to be mounted; a squeegee support arm supported by a first pivot shaft extending in parallel with the central axial line of the printing drum, and rotatable with respect to the inner circumferential surface of the printing drum toward and away therefrom; a blade holder pivotally connected to the squeegee support arm via a second pivot shaft extending in parallel with the first pivot shaft, and rotatably opposite to the squeegee support arm in synchronism with the rotation of the squeegee support arm away from the inner circumferential surface of the printing drum; a squeegee blade mounted on the blade holder and engaging the inner circumferential surface of the printing drum; and a cam mechanism rotatable in synchronism with the rotation of the printing drum for maintaining contact between the squeegee blade and the inner circumferential surface of the printing drum over an entire circumference thereof, and controlling a contact pressure between the squeegee blade and the inner circumferential surface of the printing drum to a prescribed level with respect to the concentric cylindrical part and the non-concentric cylindrical or planar part in synchronism with the rotation of the printing drum.

According to such a structure, the squeegee blade is allowed to maintain contact with the inner circumferential surface of the printing drum over its entire circumference, and the contact pressure of the squeegee blade on the inner circumferential surface of the printing drum can be favorably controlled without regard to the presence of the concentric cylindrical part and the non-concentric cylindrical part of the printing drum.

With the squeegee blade supported by a squeegee holder rotatably connected to a squeegee support arm, when the squeegee blade is located in a region corresponding to the non-concentric cylindrical part or the planar part of the printing drum, the squeegee holder is swung in the opposite direction from the squeegee support arm which rotates away from the inner circumferential surface of the printing drum so that the reduction in the squeegee angle may be avoided even when the squeegee blade is located in a region corresponding to the non-concentric cylindrical part or the planar part of the printing drum, and the volume of the ink reservoir defined by the squeegee blade and the inner circumferential surface of the printing drum can be thereby prevented from being diminished.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
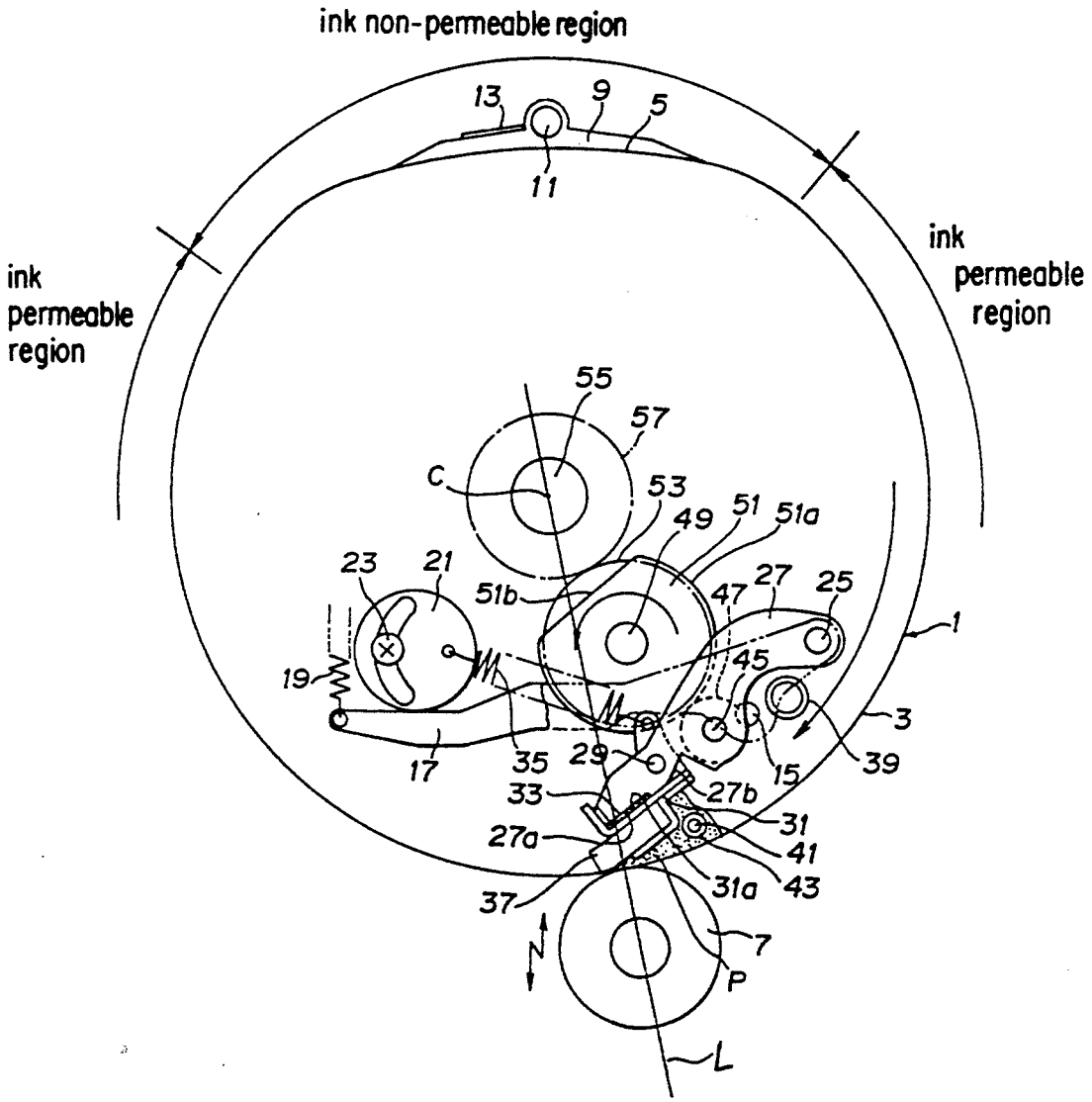
FIG. 1 is a side view of a preferred embodiment of the squeegee device for a stencil printing device according to the present invention.
Figure 2:
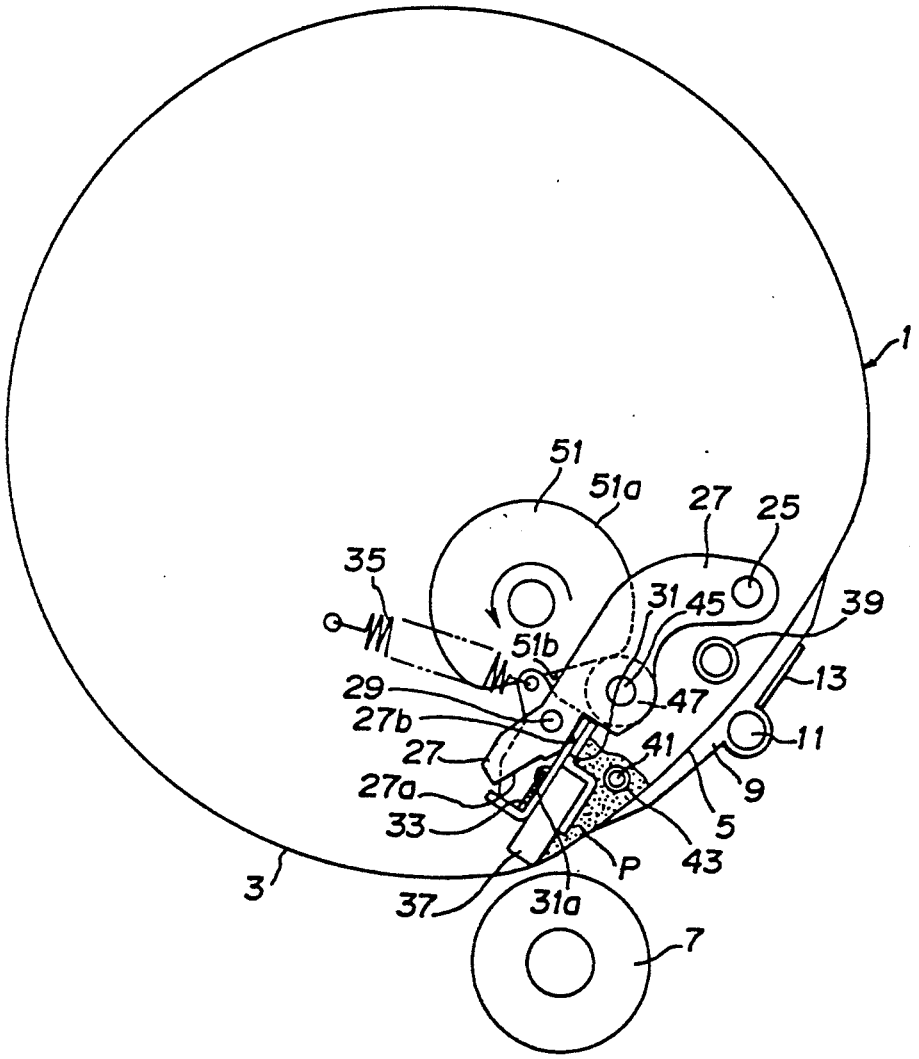
FIG. 2 is a side view of the preferred embodiment of the squeegee device for a stencil printing device according to the present invention in a different state.

FIGS. 1 and 2 show an embodiment of the blade type squeegee device for a stencil printing device according to the present invention. In the drawing, numeral 1 denotes a cylindrical printing drum. The printing drum 1 is provided with a D-shaped cross section as it consists of a concentric cylindrical part 3 accounting for a majority of the entire circumference of the printing drum 1, and a non-concentric cylindrical part 5 which is not concentric to a central axial line C of the printing drum 1. The entire printing drum 1 is made of a laminated structure combining a metallic plate and a mesh structure, and the part of the metallic plate corresponding to the concentric cylindrical part 3 is perforated and is therefore ink permeable whereas the part of the metallic plate corresponding to the non-concentric cylindrical part 5 is not perforated and is therefore not ink permeable.

The printing drum 1 is rotatively driven around the central axial line C of the concentric cylindrical part 3 in clockwise direction as seen in the drawing by conventional printing drum rotatively driving means not shown in the drawings, and printing paper not shown in the drawing is conveyed through the nip between a press roller 7 and the printing drum 1 in synchronism with the rotation of the cylindrical printing drum 1 so that the printing paper may be pressed against a stencil master plate wrapped around the cylindrical printing drum 1, and a desired print may be made on the printing paper.

On the outer circumferential surface of the non-concentric cylindrical part 5 is fixedly mounted a clamp stage member 9 for clamping a stencil master plate. On the clamp stage member 9 is rotatively mounted a clamp plate 13 by way of a pivot shaft 11 for clamping the leading edge or the head of the stencil master plate mounted on the outer circumferential surface of the printing drum 1 against the clamp stage member 9. The stencil master plate mounted on the outer circumferential surface of the printing drum 1 is wrapped around the entire concentric cylindrical part 3, and its trailing edge reaches the non-concentric cylindrical part 5.

A squeegee support base lever 17 is rotatively supported inside the printing drum 1 on a fixed member not shown in the drawing by way of a pivot shaft 15 which extends in parallel with the central axial line C of the printing drum 1. The squeegee support base lever 17 engages the outer circumferential surface of a pre-set eccentric cam 21 by the spring force of a spring 19 at its one end so that the angular position of the squeegee support base lever 17 around the pivot shaft 15 may be adjusted according to the angular adjustment of the pre-set eccentric cam 21 relative to the fixed member as effected by the rotation of a cam mount screw 23.

The squeegee support base lever 17 rotatively supports a squeegee support arm 27 by way of a pivot shaft (first pivot shaft) 25 extending in parallel with the central axial line C of the printing drum 1 at its other end so that the squeegee support arm 27 may swing toward and away from the inner circumferential surface of the printing drum 1.

The squeegee support arm 27 rotatively support a blade holder 31 at a free end portion thereof by way of a pivot shaft (second pivot shaft) 29 extending in parallel with the pivot shaft 25. The blade holder 31 is restricted in its clockwise rotation as seen in the drawings around the pivot shaft 29 relative to the squeegee support arm 27 by engaging with a lower end surface 27*a* of the free end of the squeegee support arm 27 by way of a cushioning rubber plate 33 as illustrated in FIG. 1, and is restricted in its counter-clockwise rotation as seen in the drawing around the pivot shaft 29 relative to the squeegee support arm 27 by engaging with a lower end surface 27*b* of the base end of the squeegee support arm 27 at its upper surface 31*a* as illustrated in FIG. 2, so that the blade holder 31 can swing vertically relative to the squeegee support arm 27 within this range or over a certain angular range.

The blade holder 31 is urged in counter-clockwise direction around the pivot shaft 29 relative to the squeegee support arm 27 by the spring force of a spring 35, and, in synchronism with the movement of the squeegee support arm 27 away from the inner circumferential surface of the printing drum 1 or the clockwise rotation of the squeegee support arm 27, can rotate opposite to the squeegee support arm 27 or in counter-clockwise direction as seen in the drawing.

A plate-like squeegee blade 37 is secured to the blade holder 31. The squeegee blade 37 is made of rubber-like material such as urethane rubber, and engages the inner circumferential surface of the cylindrical printing drum 1 defining a prescribed squeegee angle at its free end or its leading edge, defining a triangular region corresponding to this squeegee angle in cooperation with the inner circumferential surface of the printing drum 1 behind the point of contact between the squeegee blade 37 and the inner circumferential surface of the printing drum 1 with respect to the direction of the rotation of the printing drum 1. In this triangular region is formed an ink reservoir P by the printing ink supplied from an ink supply pipe 39. The hardness of the squeegee blade 37 may be 40 to 80 degrees of shore hardness. And the viscosity of the ink may be approximately 33,4×5,000 CP at 22° C., approximately 300,000 CP at 10° C., and approximately 100,000 CP at 30° C.

In the triangular region, an ink stirring rod 43 is rotatively supported by a support rod 41 which is in turn integrally carried by the blade holder 31 so as to be moveable therewith by being supported or guided by a side guard plate (not shown in the drawings).

A cam follower roller 47 is rotatably secured to a middle part of the squeegee support arm 27 via a shaft 45, and engages an outer circumferential surface of a cam 51 fixed secured to a cam shaft 49.

A cam 51 having a D-shaped profile is rotatively driven by a gear 57 mounted on a printing drum rotary drive shaft 55 coaxial with the printing drum 1 and meshing with a gear 53 fixedly secured to the cam shaft 49. When the squeegee blade 37 is located in a region corresponding to the concentric cylindrical part 3 of the printing drum 1 as illustrated in FIG. 1, the cam 51 urges the squeegee support arm 27 in counter clockwise direction or in other words toward the inner circumferential surface of the printing drum 1 by engaging the cam follower roller 47 at a normal circular part 51*a* of its cam profile. On the other hand, when the squeegee blade 37 is located in a region corresponding to the non-concentric cylindrical part 5 of the printing drum 1 as illustrated in FIG. 2, the cam 51 relieves the urging force acting upon the squeegee support arm 27 in counter clockwise direction by engaging the cam follower roller 47 at a chord part 51*b* of its cam profile according to the deviation of the non-concentric cylindrical part 5 directed to the interior of the printing drum 1 in relation with the concentric cylindrical part 3.

When the printing drum 1 has rotated to a position where the clamp stage member 9, the pivot shaft 11 and the clamp plate 13 for clamping the stencil master plate coincide with the press roller 7, to avoid the interference of the press roller 7 with these components, the press roller 7 is lowered by a certain distance in synchronism with the rotation of the printing drum 1 by vertical drive means not shown in the drawings. The distance of this downward movement by the press roller 7 may be less than that for the case in which the printing drum is provided with a completely circular cross section because the clamp stage member 9, the pivot shaft 11 and the clamp plate 13 for clamping the stencil master plate are mounted on a non-concentric circumference 5 of the printing drum 1 in the present case.

According to such a structure, as the printing drum 1 rotates in clockwise direction, the squeegee blade 37 engages the inner circumferential surface of the printing drum 1 at its free end, and the printing ink in the ink reservoir P, by virtue of its own viscosity, develops a vortex flow around the ink stirring pipe 43 in clockwise direction while dragging the ink stirring pipe 43 into a rotative movement. The printing ink also flows laterally (axially with respect to the printing drum 1) while it is stirred by the vortex which has developed around the stirring pipe 43 so as to be distributed evenly along the axial direction, and is pushed into the printing drum 1 from the free end the squeegee blade 37 which engages the inner circumferential surface of the printing drum 1 so that the ink may reach the reverse surface of the stencil master plate mounted on the outer circumferential surface of the printing drum 1.

During the time the squeegee blade 37 is located in a region corresponding to the concentric cylindrical part 3 of the printing drum 1 or a region corresponding to the ink permeable part of the printing drum 1, since the cam follower roller 47 engages the normal circular part 51*a* of the cam 51, the squeegee support arm 27 is kept biased in clockwise direction by a suitable amount around the pivot shaft 25 as illustrated in FIG. 1, and the squeegee support arm 27 urges the blade holder 31 toward the inner circumferential surface of the printing drum 1 by opposing the spring force of the spring 35 with the lower surface 27*a* of its free end kept in contact with the upper surface 31*a* of the blade holder 31.

As a result, the squeegee blade 37 is pushed against the inner circumferential surface of the printing drum 1 or the inner circumferential surface of the concentric cylindrical part 3 with a squeegee angle and a pressure suitable for the supply of an appropriate amount of ink. Therefore, in the ink permeable region of the printing drum 1, a suitable amount of printing ink is supplied according to the need of the stencil printing process. The point of contact of the squeegee blade 37 against the inner circumferential surface of the concentric cylindrical part 3 is in the side of the direction of the rotation of the printing drum 1 of the line L between the center of the printing drum 1 and the center of the press roller 7, so that the supply of the ink reservoir P by the squeegee blade 37 is effectively performed.

As the squeegee blade 37 approaches the end of the region corresponding to the concentric cylindrical part 3 of the printing drum 1 or in other words comes close to the non-concentric cylindrical part 5 of the printing drum or the non ink permeable part of the printing drum or the trailing edge of the stencil master plate mounted on the outer circumferential surface of the printing drum 1, the point of engagement between the cam follower roller 47 and the cam 51 moves from the normal circular part 51*a* to the chord part 51*b* with the result that the counter clockwise biasing force acting on the squeegee support arm 27 as seen in the drawing is relieved, and the squeegee support arm 27 is allowed to rotate in clockwise direction or away from the inner circumferential surface of the printing drum 1.

Thus, as illustrated in FIG. 2, the squeegee support arm 27 rotates in clockwise direction as seen in the drawing around the pivot shaft 25 under the spring force of the spring 35 while the blade holder 31 rotates in counter clockwise direction around the pivot shaft 29 with respect to the squeegee support arm 27 as seen in the drawing or downward so that the squeegee blade 37, relieved of the pressure acting thereon against the inner circumferential surface of the printing drum 1, is raised so as to increase its angle of inclination with respect to the hypothetical horizontal line while maintaining the contact with the inner circumferential surface of the printing drum 1 at its free end.

By thus relieving the pressure of the squeegee blade 37 acting upon the inner circumferential surface of the printing drum 1, the leakage of the printing ink from the trailing edge of the stencil master plate mounted on the printing drum is avoided. By the squeegee blade 37 rising so as to increase its inclination angle with respect to the hypothetical horizontal line while maintaining contact with the inner circumferential surface of the printing drum 1, the ink reservoir P can be favorably maintained over the entire circumference of the printing drum 1, and, at the same time, the decrease in the squeegee angle in the region corresponding to the non-concentric cylindrical part 5 of the printing drum 1 can be avoided with the result that the reduction in the volume of the ink reservoir P or, in other word, a loss in the amount of ink in the ink reservoir P can be avoided, and, during the subsequent process of printing, any insufficiency in the amount of ink supply can be avoided.

By the squeegee blade 37 rising in the direction to increase its inclination angle with respect to the hypothetical horizontal line, the support rod 41 and the ink stirring pipe 43 are moved away from the inner circumferential surface of the printing drum 1 along with the blade holder 31, and are therefore prevented from interfering with the inner circumferential surface of the printing drum.

As the squeegee blade 37 approaches the end of the region corresponding to the non-concentric cylindrical part 5 of the printing drum 1, or, in other words, as the squeegee blade 37 approaches the region corresponding to the concentric cylindrical part 3 of the printing drum 1, the point of contact between the cam 51 and the cam follower roller 47 moves from the chord part 51*b* to the normal circular part 51*a*, and the squeegee support arm 27 rotates in counter clockwise direction as seen in the drawing around the pivot shaft 25 so that the lower part 27*a* of the free end of the squeegee support arm 27 pushes the upper surface 31*a* of the blade holder 31 against the spring force of the spring 35, and urges the squeegee blade 37 against the inner circumferential surface of the printing drum 1.

As a result, in the ink permeable region of the printing drum 1, the squeegee blade 37 is pushed against the inner circumferential surface of the printing drum, or, in other words, the inner circumferential surface of the concentric cylindrical part 3.

In the above described embodiment, to maintain the squeegee blade 37 in contact with the inner circumferential surface of the printing drum 1 over its entire circumference, and keep the contact pressure between the squeegee blade 37 and the inner circumferential surface of the printing drum 1 at a prescribed level, contact pressure control means is formed by a combination of a linkage mechanism and a cam mechanism for controlling the contact pressure between the squeegee blade 37 and the inner circumferential surface of the printing drum 1 in synchronism with the rotation of the printing drum 1. However, the contact pressure control means may also consist of other actuators for servo controlling the position and the attitude of the squeegee blade 37, and the mode of controlling the contact pressure between the squeegee blade 37 and the inner circumferential surface of the printing drum 1 is not limited by the above described embodiment but may take various other forms for achieving a desired process of stencil printing.

In the above described embodiment, the printing drum 1 was D-shaped, consisting of the concentric cylindrical part 3 and the non-concentric cylindrical part 5, but, in the blade type squeegee device according to the present invention, the printing drum may consist of a combination of a non-concentric cylindrical part 5, and a planar chord part.

As can be understood from the above description, according to the squeegee device for a stencil printing device of the present invention, since the squeegee blade maintains contact with the inner circumferential surface of the printing drum over its entire circumference, the contact pressure between the inner circumferential surface of the printing drum and the squeegee blade is kept at a prescribed level in both the concentric cylindrical part and non-concentric cylindrical part or a planar circumference, the decrease in the squeegee angle is avoided and, hence, the decrease in the volume of the ink reservoir formed in a triangular region defined between the squeegee blade and the inner circumferential surface of the printing drum is avoided even when the squeegee blade is in a region corresponding to the non-concentric cylindrical part or the planar part, with the blade holder rotating opposite from the squeegee support arm in synchronism with the rotation of the squeegee support arm away from the inner circumferential surface of the printing drum, the ink leakage from the trailing edge of the stencil master plate is avoided, and a stable supply of ink by the squeegee blade can be reliably ensured, with the added advantage of a low noise level and a high stencil printing quality.

Although the present invention has been described in terms of a specific embodiment thereof, it is possible to modify and alter details thereof without departing from the spirit of the present invention.

What is claimed is:

1. A blade type squeegee device for a stencil printing device, comprising:

a printing drum having an inner circumferential surface and including a concentric cylindrical part extending over a major part of an entire circumference of said inner circumferential surface of said printing drum and defining an ink permeable region, a non-concentric cylindrical or planar part extending over a minor part of an entire circumference of said inner circumferential surface of said printing drum and having a central axial line different from that of said concentric cylindrical part, and an outer circumferential surface on which a stencil master plate is to be mounted;

a squeegee blade engaging said inner circumferential surface of said printing drum; and pressure control means for maintaining contact between said squeegee blade and said inner circumferential surface of said printing drum over an entire circumference thereof, and controlling a contact pressure between said squeegee blade and said inner circumferential surface of said printing drum to a prescribed level with respect to said concentric cylindrical part and said non-concentric cylindrical or planar part in synchronism with the rotation of said printing drum.

2. A blade type squeegee device for a stencil printing device according to claim 1, further comprising means for preventing reduction in a squeegee angle of said squeegee blade engaging said non-concentric cylindrical or planar part of said printing drum.

3. A blade type squeegee device for a stencil printing device, comprising:

a printing drum including a concentric cylindrical part extending over a major part of an entire circumference of said printing drum and defining an ink permeable region, a non-concentric cylindrical or planar part extending over a minor part of said entire circumference of said printing drum and having a central axial line different from that of said concentric cylindrical part, and an outer circumferential surface on which a stencil master plate is to be mounted;

a squeegee support arm supported at a first end by a first pivot shaft extending in parallel with a central axial line of said printing drum, and rotatable such that a second end moves with respect to an inner circumferential surface of said printing drum toward and away therefrom;

a blade holder pivotally connected to said second end of said squeegee support arm via a second pivot shaft extending in parallel with said first pivot shaft, said blade holder including means for rotating said blade holder opposite to said squeegee support arm in synchronism with the rotation of said squeegee support arm toward and away from the inner circumferential surface of said printing drum;

a squeegee blade mounted on said blade holder and engaging the inner circumferential surface of said printing drum; and a cam means, rotatable in synchronism with rotation of said printing drum, for rotating said squeegee support arm and said blade holder to maintain contact between said squeegee blade and said inner circumferential surface of said printing drum over said entire circumference thereof, and to control a contact pressure between said squeegee blade and said inner circumferential surface of said printing drum to a prescribed level with respect to said concentric cylindrical part and said non-concentric cylindrical or planar part in synchronism with the rotation of said printing drum.

* * * * *